US005437536A

United States Patent [19]

Bianca

[11] Patent Number: 5,437,536

[45] Date of Patent: Aug. 1, 1995

[54] VEHICLE PARKING APPARATUS AND METHOD FOR ITS OPERATION

[75] Inventor: Edoardo G. Bianca, Zollikon, Switzerland

[73] Assignee: Sotefin S.A., Schuebelbach, Switzerland

[21] Appl. No.: 147,378

[22] Filed: Nov. 3, 1993

[30] Foreign Application Priority Data

Nov. 3, 1992 [CH] Switzerland ..... 03410/92

[51] Int. Cl.[6] ..... B65G 1/04

[52] U.S. Cl. ..... 414/259; 414/253; 414/286

[58] Field of Search ..... 414/233–234, 414/239, 241, 253, 259–261, 263–264, 286

[56] References Cited

U.S. PATENT DOCUMENTS

| | | | |
|---|---|---|---|
| 2,873,865 | 2/1959 | Inglis | 414/234 X |
| 3,159,293 | 12/1964 | Bianca | 414/256 |
| 3,278,051 | 10/1966 | Shaw et al. | 414/260 |
| 3,680,718 | 8/1972 | Miyachi | 414/239 |
| 4,148,404 | 4/1979 | Heisler | 414/259 |
| 4,307,985 | 12/1981 | Desprez et al. | 414/234 X |
| 5,022,808 | 6/1991 | Blum et al. | 414/260 X |

FOREIGN PATENT DOCUMENTS

| | | | |
|---|---|---|---|
| 0374104 | 6/1990 | European Pat. Off. . | |
| 0501935 | 9/1992 | European Pat. Off. . | |
| 1183737 | 7/1959 | France | 414/259 |
| 1128966 | 11/1962 | Germany . | |
| 3823585A1 | 1/1990 | Germany . | |
| 90 15 011 U | 2/1991 | Germany . | |
| 4142172 | 6/1993 | Germany | 414/234 |
| 0038292 | 2/1990 | Japan | 414/253 |
| 5106358 | 4/1993 | Japan | 414/234 |
| 918538 | 4/1959 | United Kingdom . | |
| 946854 | 1/1964 | United Kingdom . | |
| 1004322 | 9/1965 | United Kingdom . | |
| 1188930 | 4/1970 | United Kingdom . | |
| WO/89/049-00 | 6/1989 | WIPO . | |

OTHER PUBLICATIONS

Schweizerische Bauzeitung, 32/83, 101st year, Aug. 4, 1993, pp. 1–1a.

*Primary Examiner*—Michael S. Huppert
*Assistant Examiner*—James W. Keenan
*Attorney, Agent, or Firm*—Townsend and Townsend Khourie and Crew

[57] ABSTRACT

A vehicle parking apparatus comprises at least one lift platform (12) which can be brought to parking boxes (11) provided in rows in different stories of a multi-story car park and on which at least one movable vehicle carrying pallet (13) can be arranged. The vehicle carrying pallet is formed by two box-like wheel supporting beams (14) which extend in the direction of travel and which have a length corresponding to the wheel base of the vehicle types to be accommodated and also a lateral spacing corresponding to the track widths of the vehicles to be accommodated. The wheel supporting beams (14) are in the form of an inverse U with outwardly directed angled portions (15) at the lower longitudinal edges and plates (16) which connect the lower longitudinal edges together as well as longitudinal roller arrangements (17) at the front and rear ends. At least one cross-beam (18, 19, 20) is provided at the front and at the rear of the wheel supporting beams. The cross-beams connect the wheel supporting beams (14) together and form abutments for the front and rear wheels (21, 21') of the vehicle. Furthermore, friction wheels (22) and a shifting beam (23) carrying them are provided on the lift platform and serve to drive the vehicle carrying pallets (13) during transfer thereof from the lift platform (12) to the parking boxes (11) and vice versa.

50 Claims, 8 Drawing Sheets

VEHICLE PARKING APPARATUS AND METHOD FOR ITS OPERATION

BACKGROUND OF THE INVENTION

The invention relates to a vehicle parking apparatus with a lift platform which can be brought to parking boxes provided in different stories of a multi-story car park and also a method for its operation.

A variety of parking systems of this kind are known (DE-PS 11 28 966, GB-PS 11 88 930, DE-AS 11 94 122, CH-PS 520, 852, EP 0 501 935 A1, DE-OS 28 23 585). They have the following disadvantages:

- They require a direct control and are dependent on monitoring by personnel stationed in the lift itself.
- They are not suited for computerized external control.
- They are very complex and have thus not been used in practice.
- The recycling of the pallets has not been satisfactorily solved.

SUMMARY OF THE INVENTION

In contrast, an object underlying the present invention is to provide a parking system of the initially named kind which is of low complexity, which is similar to manufacture and operate and which is suitable, in particular when used in a public multi-story car park, both for the use with a centralized and computerized external control and also for self-service operation.

In order to satisfy this object there is provided, in accordance with the present invention, a vehicle parking system comprising at least one lift platform which can be brought to parking boxes provided in rows in different stories of a multi-story car park and on which at least one movable vehicle carrying pallet can be arranged which is formed by two box-like wheel supporting beams which extend in the direction of travel and which have a length corresponding to the wheel base of the vehicle types to be accommodated and also a lateral spacing corresponding to the track widths of the vehicles to be accommodated, with the wheel supporting beams being in the form of an inverse U with outwardly directed angled portions at the lower longitudinal edges and having box section floors preferably consisting of a plurality of plates which connect the lower longitudinal edges as well as means for longitudinal rolling at the front and rear ends and, at the front and at the rear, in each case at least one, and at the front preferably two cross-beams which connect the wheel supporting beams together and are secured on the wheel supporting beams at the top, of which the front cross-beam or the front cross-beams is/are formed as an abutment for the front wheels of the vehicle and the rear cross-beam is formed as an abutment for the rear wheels of the vehicle type having the longest wheel base, and wherein the lift platform carries friction wheels and at least one pallet drive means having a shifting beam carrying the friction wheels by means of which, when the parking box or the loading or unloading spaces on the one side and the lift platform on the other side are aligned with one another, vehicle carrying pallets standing empty on the lift platform can be displaced into the parking box or into the unloading space and vehicle carrying pallets which are present in the parking box or in the loading space can be displaced onto the lift platform.

Accordingly the pallet structure comprises two especially shaped, parallel, wheel supporting beams of thin-walled sheet metal which have a downwardly open U-section with two lower angled portions as runners and also a plurality of connection plates between the latter. The beam which is thus of box-like shape is torsionally stiff and its upper surface is also resistant to denting and avoids the instability which arises with the known open trough shape with a low wall thickness through lateral buckling of the side walls under load.

The wheel supporting beams have a length which only covers the longest wheel base of the vehicles to be accommodated and have an individual width and a spacing from one another which only just accommodates the tread contact patches of the tires of vehicles to be accommodated with the largest and smallest track widths which results, apart from material saving, also in favorable loading conditions through the tires of the heaviest vehicles.

The transverse beams which connect these wheel supporting beams simultaneously serve to indicate to the driver that he has reached the desired position and—after stopping—ensure a reliable retention of the vehicles on their vehicle pallets during their displacement, and indeed even when the handbrake of the parked vehicle has not been engaged.

Through appropriate arrangement the roller a high load carrying ability is achieved even with a relatively thin wheel axle, which also contributes substantially to a light-weight arrangement.

Another particularly expedient aspect of the invention relates to the way in which the load peaks generated by the driving of the front and rear wheels of the vehicle over the entire length of the wheel supporting beams are directly picked up by the support rollers of fixed location. These load peaks are not themselves repeated during the parking movements and the parking itself since the wheel loading points on the wheel supporting beams remain unchanged in the direct vicinity of the pallet support rollers. In this way a considerable reinforcement of the carrying beam structure which would otherwise be necessary, or alternatively a plurality of carrying rollers on all pallets, is avoided. The thereby obtainable material and manufacturing cost savings for the vehicle carrying pallets of the invention are about 50% in comparison to the pallets of known parking systems, which leads to a considerable saving having regard to the fact that there are normally over 100 pallets for each individual vehicle parking system. Since the support rollers are only provided in the loading and unloading spaces the cost and effort of providing them is comparatively low. In a further embodiment of this invention the inner flanks of the inverted U-shaped carriageway carriers are simultaneously used as drive surfaces for the engagement of the frictional wheels.

The present invention further contemplates to provide a central auxiliary rail of the same length as known per se on the vehicle carrying pallet for its transport.

The present invention further advantageously provides that the drive of the vehicle carrying pallets during the acceleration phase automatically enhances the contact pressure of the frictional wheels against the oppositely disposed drive surface during driving, with a resulting reduction of the pressure during braking and in the opposite direction of travel being unproblematic because, in this case, the vehicle carrying pallets have already been accelerated so that they only need to be held against travelling further and braked until they reach their end position.

For the interchanging of empty and full vehicle carrying pallets at the individual parking boxes the present invention employs a design which avoids the use of at least one parking box as an exchange buffer station with longer travelling and turn-around times.

Another aspect of the invention arranges the guide beams to ensure that broad track vehicles and their wheels can be effortlessly aligned and parked even by self-parkers without breakdown or danger on the wheel supporting beams which, in accordance with the invention, are narrow and which each only correspond to the lateral wheel tracks of the vehicles to be accommodated within their outer edges.

The same is provided with reference to the alignment of narrow track vehicles by using liftable inner guide beams. Moreover the plates connected to the guide beams cover the opening which otherwise exists between the wheel supporting beams of the vehicle pallet which has been prepared to accept the vehicle, so that even with extreme driving errors of the incoming driver the dropping of a wheel into the inner opening is prevented.

The prevention or hindering of a loaded pallet being moved away due to firm contact of a tire on one of the compulsorily tracking members is avoided in that, before moving the pallet away, the outer guides are freed and the inner guides are withdrawn. In this manner an overloading or inability of the friction roller drive to function is prevented.

A further advantage provided by the invention is that the friction wheels are brought reliably into force-locked engagement with the drive surfaces associated with them, so that an effective and high acceleration is ensured at the start of the movement of the vehicle carrying pallets as well as reduced wear of the friction wheels.

The above-described features of the present invention and others contribute to the vehicle carrying pallets themselves being of an extremely simple, light-weight but nevertheless adequately stable construction since as many construction elements as possible are kept away from the vehicle carrying pallets and are arranged at another position where they only have to be present once or a few times but not however a hundred times.

DESCRIPTION OF THE PREFERRED EMBODIMENTS

Figure 1:
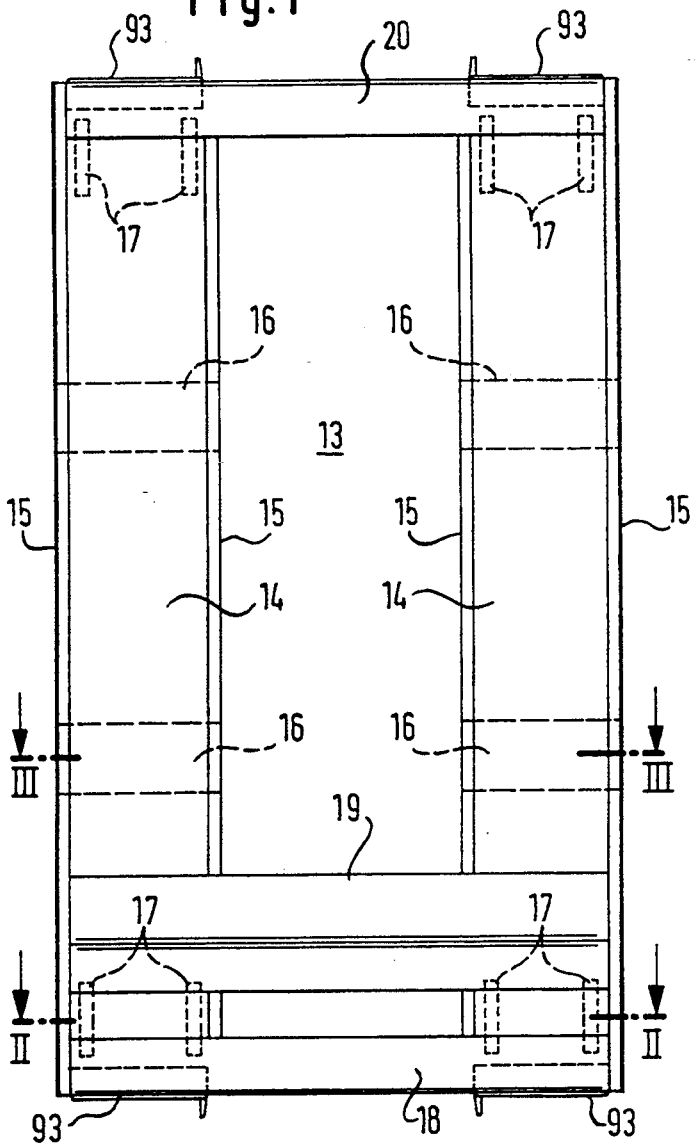
FIG. 1 is a schematic plan view of a vehicle carrying pallet of a vehicle parking system made in accordance with the invention.

In all figures the same reference numerals designate corresponding components.

In accordance with FIGS. 1 to 4 a vehicle carrying pallet 13 of a vehicle parking apparatus in accordance with the invention comprises two wheel supporting beams 14 of thin-walled steel in the shape of an inverted U which are arranged laterally spaced apart parallel to one another with outwardly directed, horizontal, angled portions 15 located at the lower margins of the side flanks of the wheel supporting beams 14. At the front the two wheel supporting beams 14 are connected by two cross-beams 18, 19 which are spaced apart and are secured to the upper side of the wheel supporting beams 14, whereas at the rear end one cross-beam 20 is secured to the upper side of the wheel supporting beams 14 and connects them together. In this manner a frame arises which is rectangular in plan view (FIG. 1).

Figure 3:
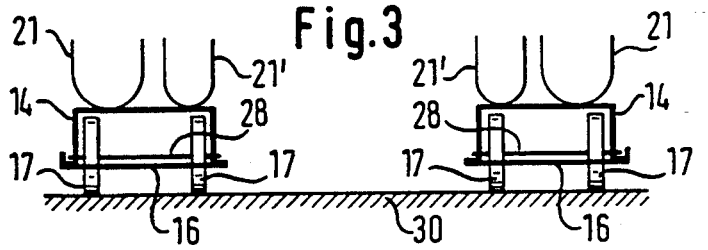
FIG. 3 is a schematic section taken on line III—III in FIG. 1.

In accordance with FIG. 3 the lateral spacing and width of the wheel supporting beams 14 is so selected that both the front vehicle wheels 21 of wide track vehicles and also the front wheels 21' of narrow track vehicles find a place thereon, i.e. fit thereon.

Figure 4:
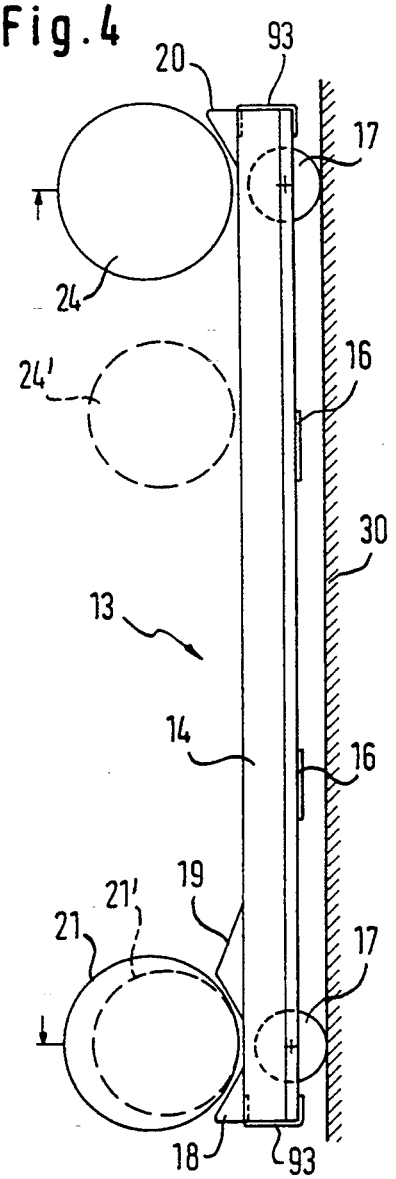
FIG. 4 is a schematic side view of FIG. 1.
Figure 2:
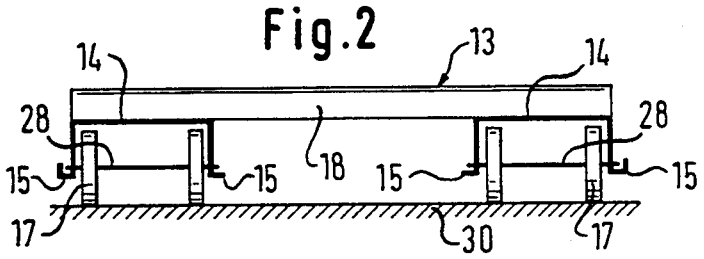
FIG. 2 is a schematic section taken on line II—II in FIG. 1.

Stiffening plates 16 are secured to the lower side of the wheel supporting beams 14 at specific intervals in the longitudinal direction in accordance with FIGS. 1, 3 and 4 and function as a whole to provide a box section which can be seen from FIG. 3 which is particularly resistant to denting, buckling and torsion.

At the front and at the rear roller arrangements are provided at the four corners of the vehicle carrying pallet 13 and each consist of two wheels or rollers 17 having a lateral spacing and a wheel axle 28 connecting them which is journalled in the lower region of the two flanks of the track carriers 14, i.e. of the wheel supporting beams. The wheel axle 28 is either rotatably journalled in the flanks or the wheels are rotatably journalled on the fixed axle 28. It is important that the wheels 17 are located close to the associated flanks of the track carrier 14, whereby the wheel axle 28 can be made relatively weak without this leading to bending of the same.

Figure 7:
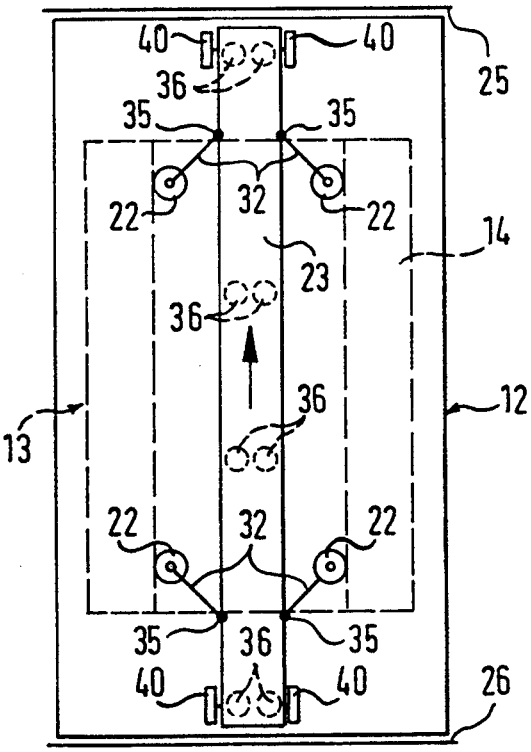
FIG. 7 is a schematic plan view of a lift platform of a vehicle parking system in accordance with the invention with the shifting beam located in the rest position and with a vehicle carrying pallet indicated in broken lines.
Figure 9:
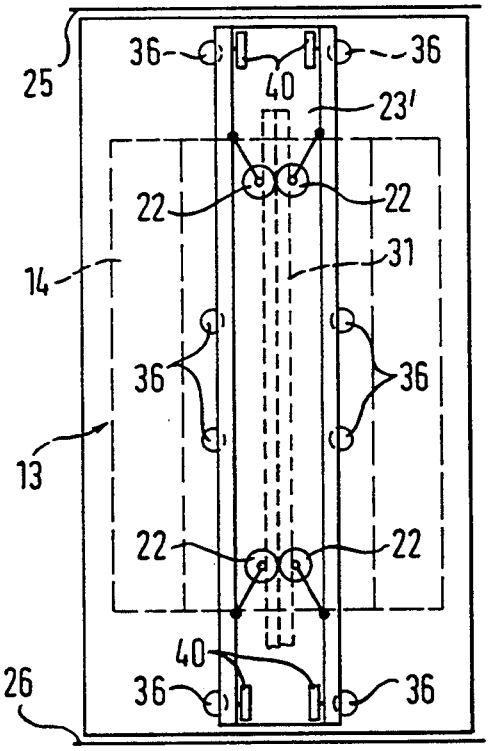
FIG. 9 is a schematic plan view analogous to FIG. 7 of the embodiment of FIG. 8.

The arrangement of the wheels 17 and of the wheel axle 28 is such that the vehicle pallet 13 is displaceable on a parking floor 30 or on a lift platform 12, for example as can be seen from FIG. 7, in the longitudinal direction of the track carriers 14.

In accordance with FIG. 4 the cross-beams 18, 20 are preferably made wedge-shaped such that they can serve as an abutment surface for the front vehicle wheels 21, 21' or the rear vehicle wheels 24, with it being assumed that the vehicle wheels 21, 24 belong to a vehicle with the maximum wheel base, the vehicle wheels 21', 24' to a vehicle with a short wheel base.

In order that vehicles with a short wheel base in accordance with the broken-line illustration of the front wheels 21' and of the rear wheels 24' can be retained in trouble-free manner on the vehicle carrying pallet 13, a spacing is provided between the cross-beams 18 and 19 which takes account of the diameter of the front wheels 21, 21' in such a way that vehicle front wheels 21 or 21' located between the cross-beams 18, 19 are reliably held in both directions of travel.

The wheel supporting beams 14 are closed off at the ends with sheet metal heads 93 which contribute further to increasing the stability. For this purpose the sheet metal heads 93 of FIGS. 4 and 5 are also bent over at the lower end towards the vehicle carrying pallet 13 and also secured there to the wheel supporting beams 14 in order to also close the downwardly open U-section in box-like manner at both ends.

Figure 5:
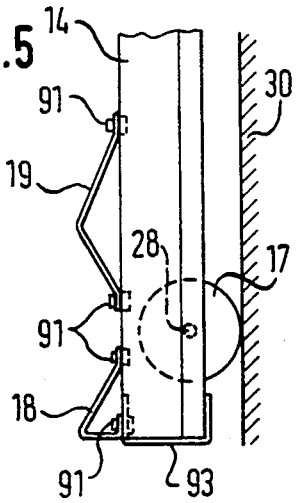
FIG. 5 is a partial view, corresponding to FIG. 4, of a further embodiment of the front part of the vehicle pallet of FIG. 4.

In accordance with FIG. 5 the cross-beams 18, 19, 20, can be manufactured from relatively thin bent sheet metal and are advantageously bolted to the wheel supporting beams 14 at 91.

The lower part of the wheel supporting beams 14 is effectively loaded in tensile strain which is above all picked up by the angled portions 15, while the upper support surface picks up both the compressive strains of the load and also the transverse bending strains through the concentrated loads on the part of the tires. In this way a favorable minimum specific material loading arises which is matched to the loads and permits a very small material thickness.

With the eccentric loading cases which necessarily arise, in particular due to heavy wide track vehicles, the torsion or stiffness generated by the box construction also signifies a more uniform load distribution to the individual wheels or rollers 17.

Figure 8:
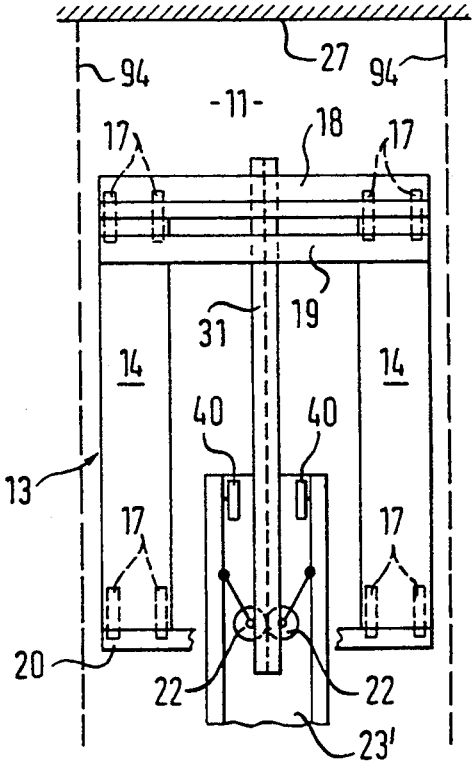
FIG. 8 is a schematic plan view analogous to FIG. 6 of a further embodiment of the invention.

It is of particular significance for the invention that the upper support surface of the wheel supporting beams 14 is free of lateral boundaries. Since the tread of the vehicle tires only amounts to ca. 75% of the tire width the upper width of each wheel supporting beam 14 can be dimensioned to be less than half the difference between the largest outer width and the smallest inner width between the wheel pairs of the vehicle on the same axle. The length of the wheel supporting beams 14 is restricted to the longest wheel base (21–24 in FIG. 4) which arises so that the gross ground area of the vehicle carrying pallet 13 only amounts to approximately 60% of the gross area of the parking box 11 (see for example FIGS. 6, 8) in which it is to be accommodated and to only 30% net.

As a result of the construction of the invention a material saving of circa 50% is achieved in comparison to known embodiments. Even higher are the savings of manufacturing wage costs through a centralized series-wise production of the individual parts of the design. In addition, the type of connection of the cross-beams 18, 19, 20 illustrated in FIG. 5 by means of screw connections at 91 makes it possible to transport the pallets broken down into individual parts, whereby transport with installation on site can be carried out at a particularly favorable cost.

The wheel supporting beams 14 of the invention can be manufactured and produced at favorable price in series by using a largely automated CIM production with essentially two working steps which consist in an automatic stamping of all holes of the pre-cut sheet metal plates and subsequent folding.

Figure 6:
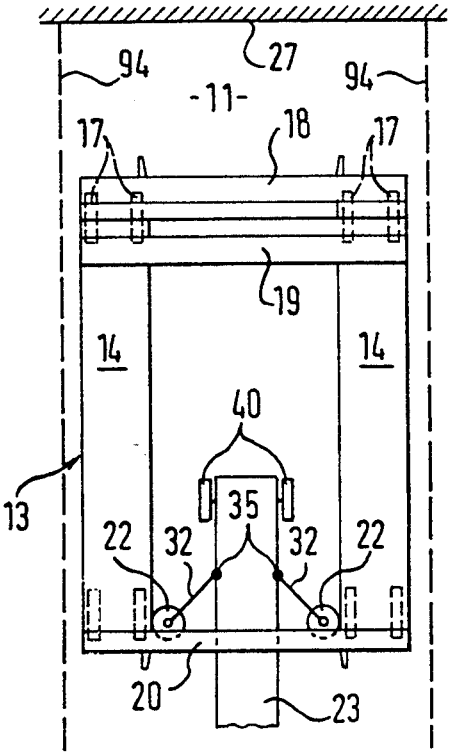
FIG. 6 is a schematic plan view of a parking box containing a vehicle carrying pallet of a vehicle parking system made in accordance with the invention at the end of the loading procedure or at the start of an unloading procedure.

In FIG. 6 the vehicle carrying pallet 13 of FIGS. 1 to 5 is illustrated in its parked position in a parking box 11, the boundaries of which are indicated in broken lines at 94. They are aligned approximately with the side edges of an adjoining lift platform 12 (FIG. 7).

In FIG. 7 the vehicle carrying pallet 13 is shown in broken lines in its transport position on a lift platform 12 which can be lifted and raised and can optionally also be horizontally moved in a lift shaft with front and rear lift shaft edges 25, 26.

Figure 11:
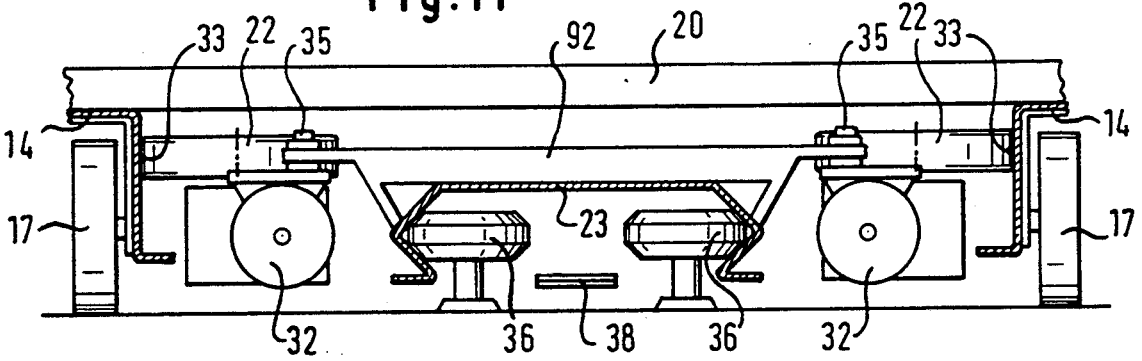
FIG. 11 is a somewhat enlarged sectional view in accordance with line XI—XI in FIG. 10.
Figure 13:
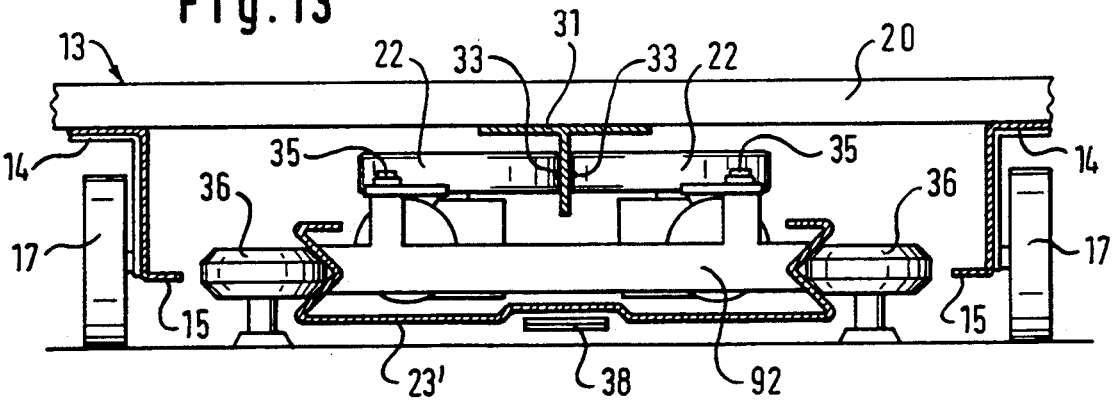
FIG. 13 is a somewhat enlarged schematic sectional view in accordance with line XIII—XIII in FIG. 12.

A shifting beam 23 which extends from one lift shaft edge 25 to the other lift shaft edge 26 in the direction of the vehicle carrying pallet 13 is provided on the lift platform 12 and is axially displaceably arranged in both directions on carrying guide rollers 36 which are illustrated in detail in FIGS. 11 and 13 and are rotatably secured to the lift platform 12 about vertical axes. The shifting beam 23 extends practically from the front to the rear end of the lift platform 12 and is secured against collision at its two ends by wheels 40 with horizontal and transversely extending axes.

At the level of the front and rear regions of a vehicle carrying pallet 13 arranged in its transport position on the lift platform 12 there are provided motor transmission drive groups 32. These are pivotally arranged at the side about vertical hinges 35 on the shifting beam 23 and carry friction wheels 22 with vertical axes at their ends remote from the shifting beam 23, with the wheels 22 being drivable by the motor-transmission drive groups to execute a rotational movement in both directions. The angle $\alpha$ (FIG. 10) is of particular significance for a trouble-free drive, in particular for a hard acceleration of the vehicle carrying pallet 13 to be moved as will be explained further below with reference to FIGS. 10 and 12.

The shifting beam 23 can be displaced from the rest position of FIG. 7 into a parking box 11 into the position evident from FIG. 6 by later described drive means when the lift platform 12 is aligned with the floor 30 of the parking box 11. A corresponding movement is also possible in the reverse direction in the direction of the shaft edge 26, so that the drive means makes it possible to transfer the vehicle carrying pallet 13 in both directions.

A transfer process out of the position of FIG. 7 proceeds for example in such a way that first of all the shifting beam 23 is displaced in the direction of the arrow in FIG. 7 into the parking box 11 with which the lift platform 12 has previously been aligned, with the rear friction wheels 22 in FIG. 7 which, in the same way as the front friction wheels, are not initially driven, transmitting, as a result of the opening angle $\alpha$ of the motor transmission drive groups 32, the drive forces rearwardly onto the flanks of the wheel supporting beams 14. As soon as the shifting beam 23 has reached the position evident from FIG. 6 the front friction wheels 22 take on the further transport as a result of the rotational drive by the motor transmission drive groups 32. Despite the rearwardly opening angle of the front friction wheels 22 a slip-free drive force transmission to the vehicle carrying pallet 13 takes place because the friction wheels 22 are pressed by springs 34 evident from FIG. 10 against the flanks of the wheel supporting beams 14 with a suitable force. Acceleration of the vehicle carrying pallet 13 has already commenced through the rear friction wheel pair of the advancing shifting beam 23. The driven front friction wheels 22 thus also only need to maintain the already prevailing movement until the end position of the vehicle carrying pallet 13 within the parking box 11 evident from FIG. 6 has been reached. The drive of the motor-transmission drive group 32 is then reversed and the shifting beam 23 is simultaneously drawn back into the rest position evident from FIG. 7. The lift platform 12 can now be moved to some other parking box 11 or to a loading space 66 in accordance with FIG. 16 or to an unloading space 67 in accordance with FIG. 17 in order to pick up other pallets 13 there.

With such a transfer of the vehicle pallet 13 from the parking box 11 onto the lift platform 12 the shifting beam 23 stationed on the latter is first extended in the direction of the box 11 with the friction wheels 22 turning with the same peripheral speed in the rearward direction until the front pair of wheels has reached the flanks of the wheel supporting beams 14 and after a short travel stands in force-transmitting communication with them. The shifting beam displacement is then reversed while the friction wheels continue to turn and the vehicle pallet 13 is conveyed to the middle of the lift platform 12 with the sum of the two speeds. The increased drivability of the friction drive necessary during the acceleration is achieved by the automatically arising enhancement of the contact pressure of the friction wheels through the action of the control angle $\alpha$ of the drive groups 32. In the two functional procedures described above the retardation of the loaded pallet is ensured in that the travel resistance of the rolling pallet is increased by the negative acceleration generated by the friction wheels, and indeed as a compensation for the reduction of the contact pressure by the reversal of the action of the control angle $\alpha$.

Figure 10:
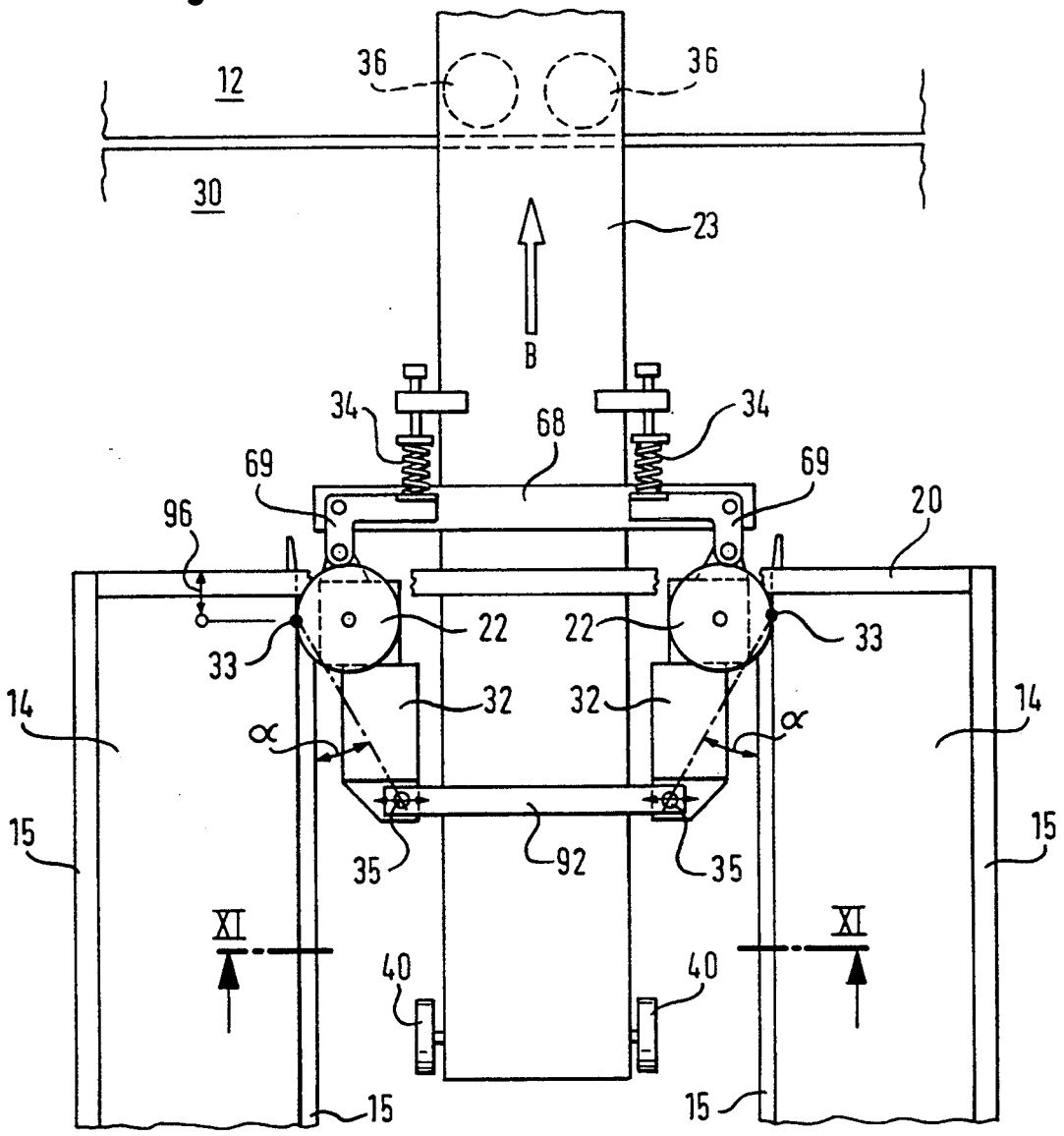
FIG. 10 is an enlarged schematic plan view of a part of a parking box and of a lift platform, with the vehicle carrying pallet located in its end position in the parking box and with engagement of the drive means with the vehicle carrying pallet.

FIG. 10 shows an enlarged partial view of a vehicle carrying pallet 13 located in a parking box 11 with the shifting beam 23 however extending away from the lift platform 12 as in FIG. 6 but in precisely the opposite direction. In other respects, the relationship between the shifting beam 23 and the vehicle carrying pallets 13 which is located in its end position is the same as in FIG. 6.

It can be seen from FIGS. 10 and 11 that the shifting beam 23 has a downwardly open, C-shaped cross-section with sigma-like side walls into which the carrying guide rollers 36 engage from the inside. The motor-transmission drive groups 32 are pivotally mounted about the vertical hinge axes 35 on the shifting beam 23 by means of carriers 92. Cranked levers 69 loaded by springs 34 are likewise hinged to carriers 68 secured to the shifting beam and bias the friction wheels 22 secured to the ends of the motor-transmission drive groups 32 remote from the hinges 35 against the inner flanks of the wheel supporting beams 14.

An acute angle $\alpha$ is provided between the straight lines between the hinges 35 and the contact position 33 between the friction wheels 22 and the flanks of the wheel supporting beams 14. In this way, on driving the shifting beam 23 in the direction of arrow B the contact pressure force of the friction wheels 22 against the flanks of the wheel supporting beams 14 correspondingly enhances the acceleration of the drive, whereas when the drive is in the opposite direction the contact pressure of the friction wheels 22 on the flanks is reduced. This effect is exploited in accordance with the invention to increase the drive force transfer during the acceleration phase and to reduce it once the movement of the vehicle carrying pallet has been initiated and only needs to be maintained.

The FIGS. 8, 9 and 12, 13 show the same arrangements as the FIGS. 6, 7, 10 and 11 of another embodiment which operates with a central lower auxiliary rail 31 on the vehicle carrying pallet 13 and with a shifting beam 23' which, in accordance with FIG. 13, has a cross-section corresponding to an upwardly open C with sigma-shaped side walls. The embodiment of FIGS. 8, 9, 12, 13 operates in the same manner as that described with reference to FIGS. 6, 7, 10 and 11 apart from the fact that the shifting beam 23' is guided and held by carrier support rollers 36 which act from both sides from the outside and that the friction Wheels 22 are biased onto a central auxiliary rail 31 and act on this drive-wise.

The wheels arranged at the front and rear ends of the shifting beam 23, 23' serve as security against small differences in level between the lift platform 12 and the floor 30, 30' of the parking box 11 or loading and unloading spaces 66, 67 aligned therewith. In accordance with the invention, when the danger of level differences which are too great is present, an installation is provided with resilient bearings with overload contacts in the rolls or wheels 40, with the contacts being so connected with the control that they switch off the extension movement on responding and thus prevent damage of the different components which are movable relative to one another. In accordance with the invention, with a joint drive of the vehicle carrying pallets 13 by the friction wheels 22 and the shifting beams 23 or 23', respectively, both elements each take on half the effective speed of travel of the vehicle carrying pallet. The two drives preferably start-up sequentially, whereby in the critical first start up phase the correspondingly smaller acceleration favors the security of the vehicle on the pallet 13.

The symmetrical arrangement of the friction wheels 22 and their drives on both sides of the central longitudinal axis of the vehicle carrying pallet 13 is of particular importance.

In accordance with a particularly preferred embodiment of the invention the motor-transmission drive groups 32 are formed for lateral adjustment and fixation in the region of the hinge 35 transverse to the longitudinal direction of the shifting beam 23, 23' (see the double-arrow in FIGS. 10, 12), whereby the angle $\alpha$ can be set to a desired value.

Figure 12:
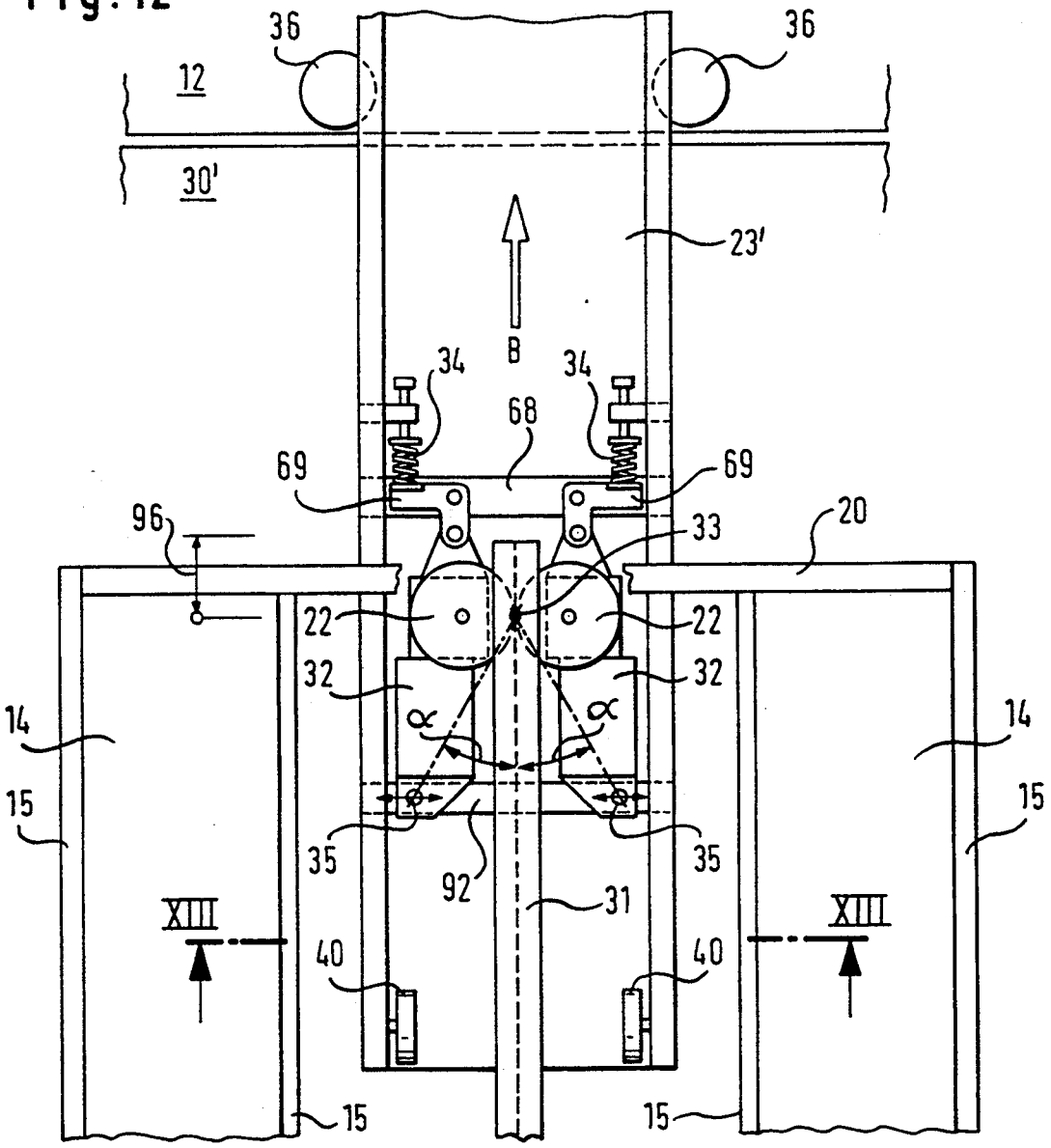
FIG. 12 is an analogous schematic plan view to that of FIG. 10 of a further embodiment of the invention.

If this angle $\alpha$ is selected in accordance with the illustrations in FIGS. 10 and 12 to be equal to approximately 30° to the longitudinal direction of the shifting beam 23, 23' then, on acceleration of the drive in the direction of the lift platform 12, a greater pressure and force-locked transmission of the friction wheels 22 to their drive surfaces is achieved automatically by the reaction force and without increasing the spring force by ca. the factor 1.7. The reduction of the contact pressure force which arises on driving in the reverse direction to ca. 0.7 times the static pressure does not have a disadvantageous effect since during braking, and with the vehicle carrying pallet 13 travelling, at most half the drive force is required. Thus, as a result of the arrangement of the invention, the static spring force can be reduced by ca. 40% in comparison to customary friction wheel drives, which both facilitates the run-in of the friction wheels onto the contact surface and also reduces the wear.

Figure 14:
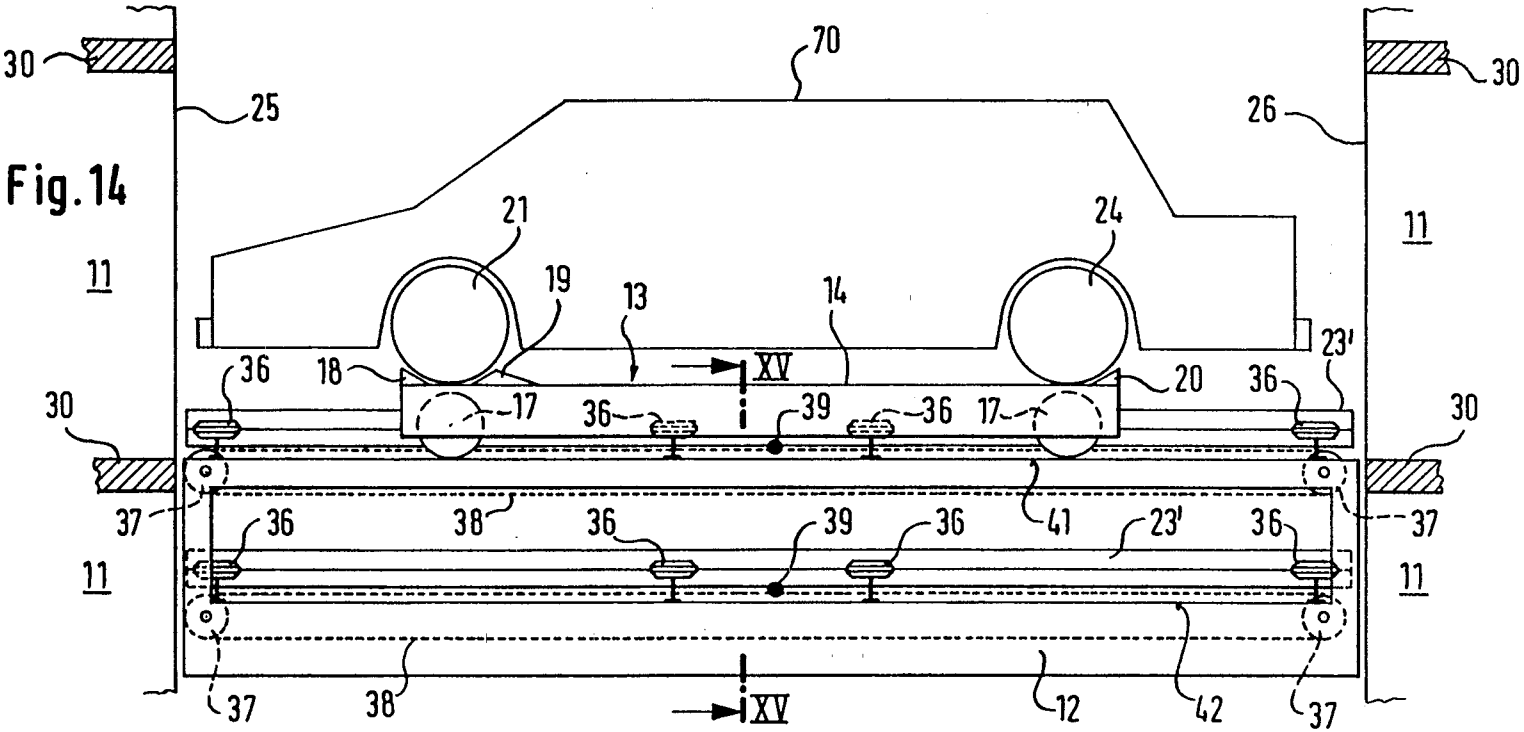
FIG. 14 is a schematic side view of a lift platform arranged in a lift shaft with a vehicle carrying pallet arranged thereon and in turn carrying a vehicle.
Figure 15:
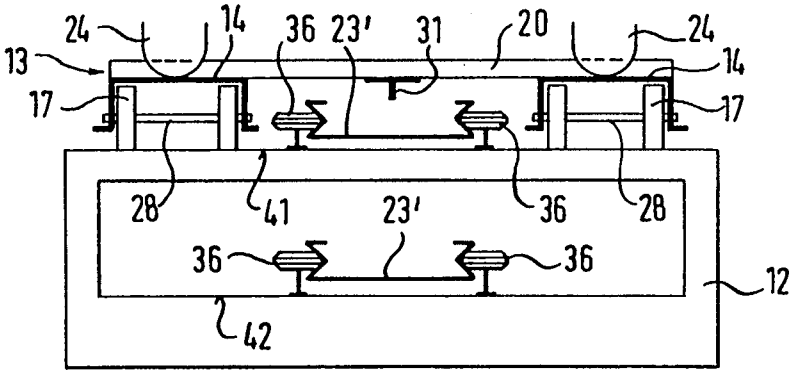
FIG. 15 is a schematic sectional view in accordance with the line XV—XV in FIG. 14.

In FIGS. 14 and 15 the lift platform 12 with a vehicle carrying pallet 13 thereon which in turn carries a vehicle 70 is illustrated in a conveyor shaft with shaft edges 25, 26, with the special feature lying in the fact that the lift platform 12 has two plateaus 41, 42 intended for receiving vehicle pallets 13 of which the one 41 is exclusively associated with the pallets loaded with a vehicle, whereas the other auxiliary plateau 42 arranged closely beneath it, or above it, accommodates exclusively unloaded pallets.

Both said plateaus 41, 42 are equipped with a pallet transfer apparatus in accordance with the invention. These operate independently from one another and consist of shifting beams 23, 23' friction wheel drives 32 and associated parts, with the drive of each shifting beam taking place by a toothed belt 38 which is shown in broken lines and which is guided around deflection rollers 37 at the front and rear ends of the plateaus 41, 42 and is fixedly connected at 39 with the respective shifting beam 23, 23'. By driving one of the deflection rolls 37 the shifting beam 23, 23' can be displaced in this way in the one or other direction. The toothed belt 38 is also schematically illustrated in cross-section in FIGS. 11 and 13.

In accordance with the method of the invention the two plateaus 41, 42 are each alternatively occupied by one exchanged pallet prior to and after a pallet exchange has taken place. Accordingly the transfer drives as shown in FIGS. 6 to 9 are likewise alternatively actuated with a corresponding connection (alignment) of the respective plateau to one parking box or one loading or unloading station.

The drive speed for the transfer of unloaded pallets 13 into or out of the auxiliary pallet 42 is advantageously substantially higher, for example more than twice that of pallets loaded with vehicles into or out of the main plateau 41, whereby the transfer times are approximately halved and the total parking cycle is substantially shortened.

Figure 16:
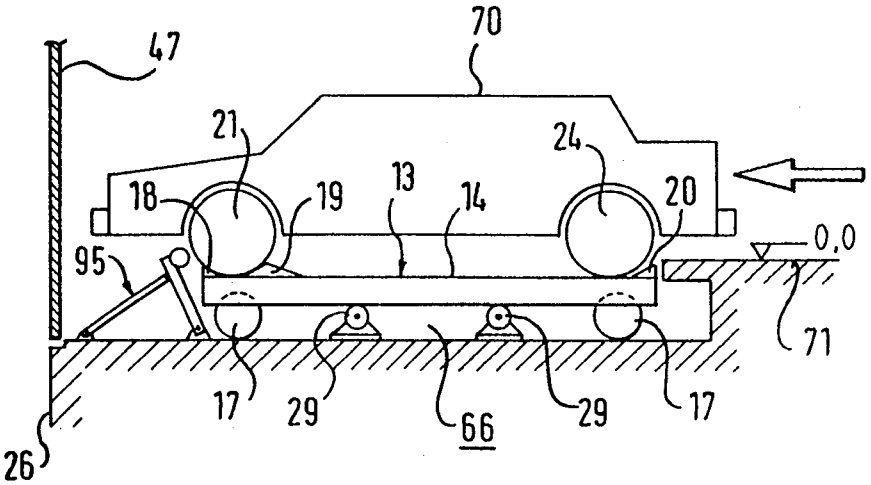
FIG. 16 is a schematic side view of a vehicle carrying pallet carrying a vehicle in the vehicle loading space.

FIG. 16 shows the loading space 66 in which a vehicle carrying pallet 13 in accordance with the invention is arranged with support rolls 29 being located beneath the vehicle loading pallet 13 and engaging from below on the stiffening runners 15 of the wheel supporting beams 14.

The vehicle 70 illustrated in FIG. 16 has been driven onto the pallet 13 from a track 71 which is located at approximately the same level as the upper surface of the vehicle carrying pallet 13. At the front both the pallet 13 and also the vehicle 70 is secured against being advanced by a buffer apparatus 95 described in detail below. The pallet 13 is located in front of the lift door 47 which is opened as soon as the lift platform 12 is located at the correct position in the lift shaft.

Figure 17:
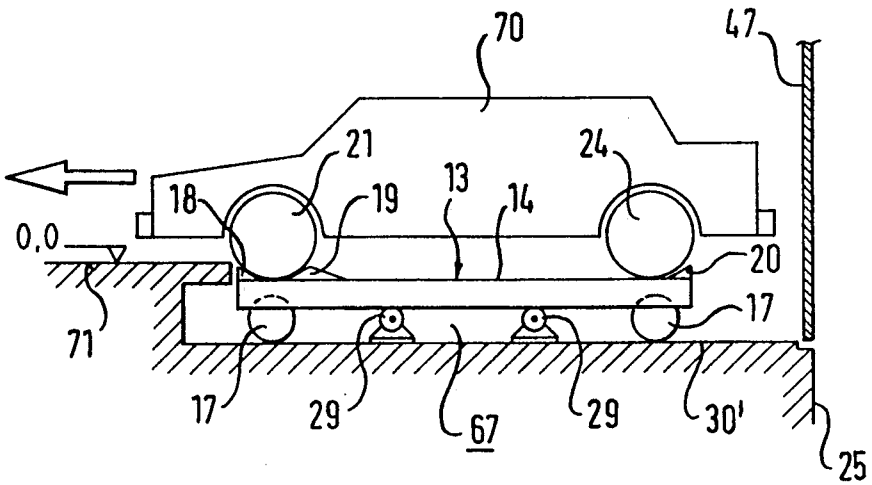
FIG. 17 is a corresponding side view of the vehicle carrying pallet in the unloading space.

The support rollers 29 are also provided at the floor of the discharge space 67, i.e. the unloaded station or space, illustrated in FIG. 17 and relieve the vehicle carrying pallet 13 when the vehicle 70 is driven out.

Figure 18:
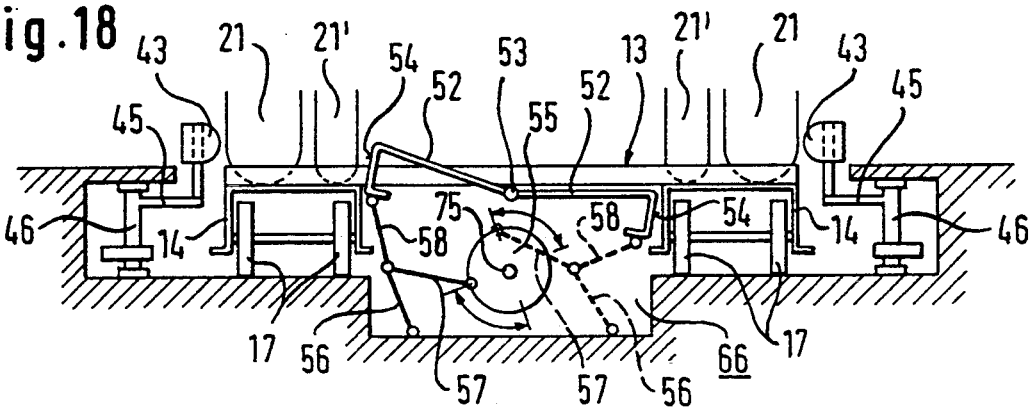
FIG. 18 is a schematic cross-sectional view of the loading space with a vehicle carrying pallet having vehicle wheel tracking elements located therein.
Figure 19:
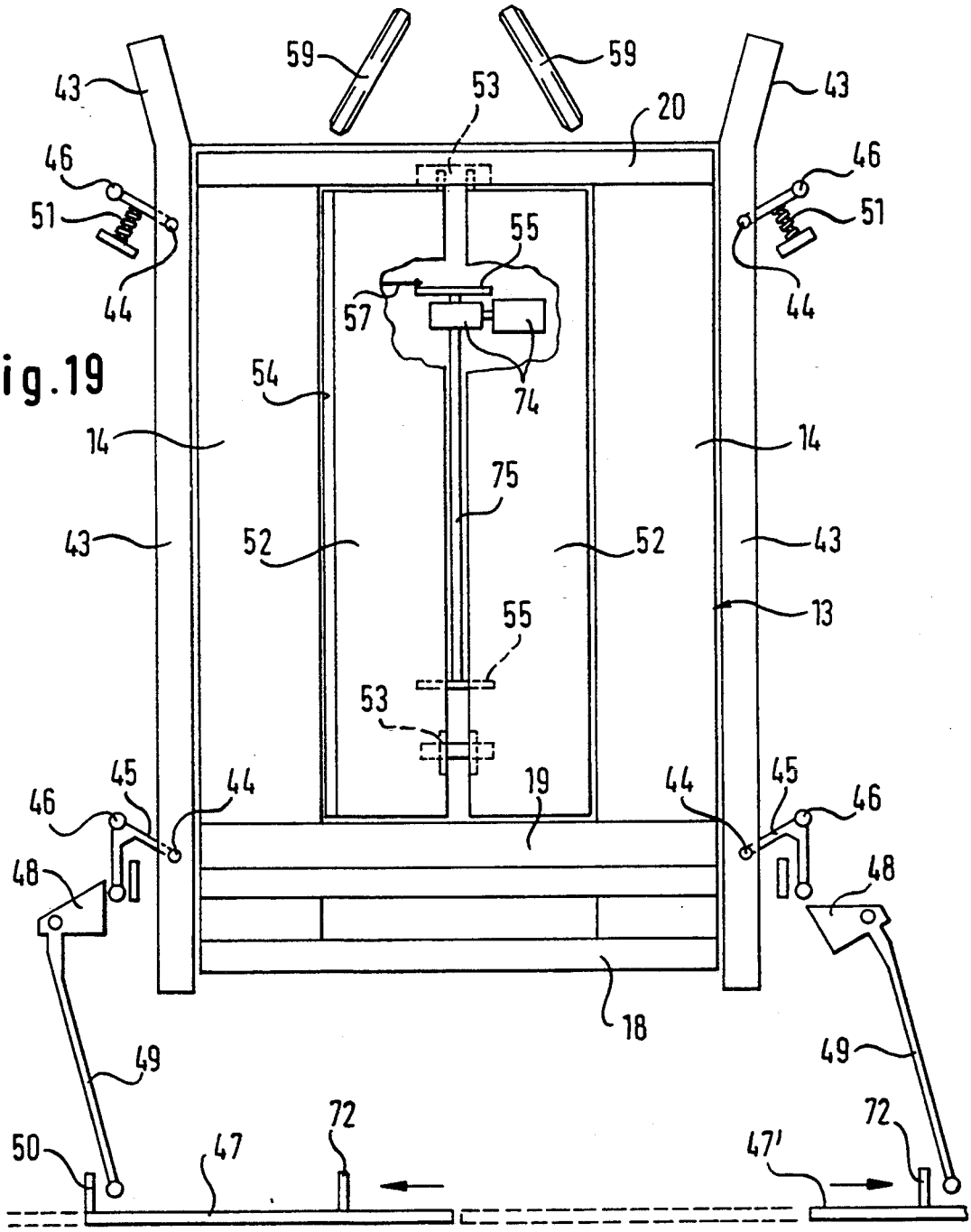
FIG. 19 is a plan view of FIG. 18.

Guide beams 43 for the vehicle wheels which run up onto the pallet 13 are provided in FIGS. 18 and 19 to the sides at the loading space 66 and are connected via hinges 44 to outriggers 45 which in turn are locally pivotally journalled about vertical axes 46. This ensures breakdown-free and danger-free loading of pallets 13 which stand ready during parking, in particular by self-parkers, bearing in mind the narrow width of the wheel supporting beams 14 which are each restricted to the left- or right-side tire contact track of the vehicle to be parked thereon. During the loading process with the shaft door 47 closed the outriggers 45 are located in the illustrated position at an angle of approximately 20° to 30° to the direction of travel. They are however blocked by a latch 48 actuated by a door abutment 50 and a lever 49. In this way the guide beams 43 are also held at a distance alongside the track carriers 14 such that a trouble-free outer lateral guidance of the vehicle wheels on the wheel supporting beams 14 is ensured.

On opening of the shaft door 47 prior to the transfer process the compulsory position of the guide beams 43 is cancelled by actuation by means of abutments 72 which move in the direction of the arrows in that the towed lever 49 is moved along and so actuates the latch 48 that the outrigger 45 can pivot outwardly somewhat under the action of the vehicle tires which frequently stick somewhat as a consequence of the guide forces that are exerted and only minor non-deleterious, residual friction remains due to the weak return guidance springs 51 which does not prevent the transfer of the loaded pallet.

When closing the shaft door 47 after transfer of the loaded pallet has taken place and after the insertion of an exchanged empty pallet 13 the guide beams 43 are moved by weak return guide springs 51 back into the inner guidance position and are blocked by the latch 48.

In accordance with FIGS. 18 and 19 floor plates 52 are also provided in the free space between the track carriers 14 and are upwardly and downwardly pivotable in the manner which can be seen from FIG. 18 about central hinges 53. At their outer sides the floor plates 52 have downwardly pointing guide beams 54 which in the upwardly pivoted state (to the left in FIG. 18) guide the vehicle wheels 21 and 21' respectively at the inside. The floor plates 52 with the guide beams 54 thus have a double function. On the one hand they act as a closure for the inner space of the vehicle carrying pallets 13 so long as they are located for loading in the loading space 66, and, on the other hand, they also act as an inner guide for the vehicle wheels.

For the drive of the floor plates 52 there is provided an eccentric device 55 arranged in a lower floor recess which acts via push rods 57 on toggle lever mechanisms 56, 58 in such a way that on rotation of the eccentric device 55 the floor plates 52 are lifted out of the horizontal position illustrated to the right in FIG. 18 about the central hinge 53 into the position illustrated in FIG. 18 to the left of the hinge 53.

In accordance with FIG. 19 two eccentric devices 55 are provided which are spaced apart in the axial direction and which can be set in rotational movement via a connection shaft 75 from a common drive 74.

Since, in the deployed position of the floor plates 52 in accordance with the illustration to the left of the hinge 53 in FIG. 18, the toggle lever mechanism 56, 58 is extended, practically no forces caused by eventual riding up of vehicle wheels are transferred back to the drive 74.

In the lowered position of the floor plates 52 these are located beneath the level of the cross-beams 18, 19 and 20 so that the vehicle carrying pallet 13 is displaceable in unhindered manner.

Furthermore, conically divergent in-guiding rollers 59 for the inner flanks of the vehicle wheels are provided in FIG. 19 at the incoming end so that the vehicle wheels are reliably guided onto the wheel supporting beams 14.

Figure 20:
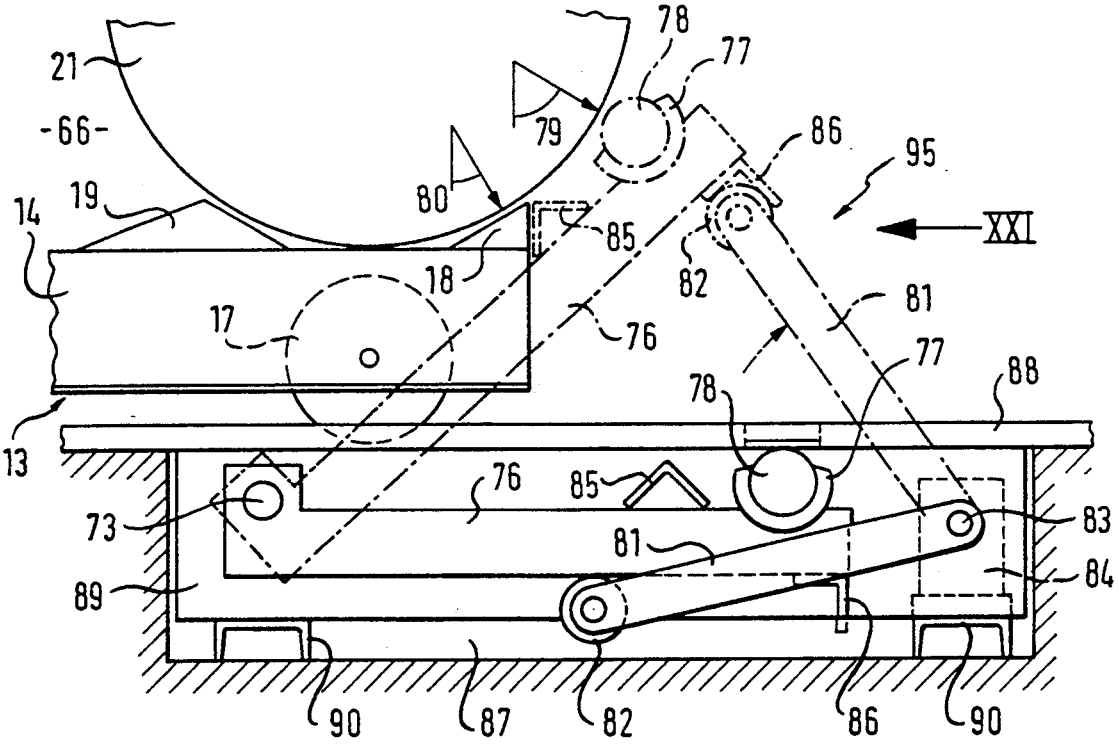
FIG. 20 is an enlarged side view of a buffer provided at the front end of the vehicle carrying pallet in the loading space.
Figure 21:
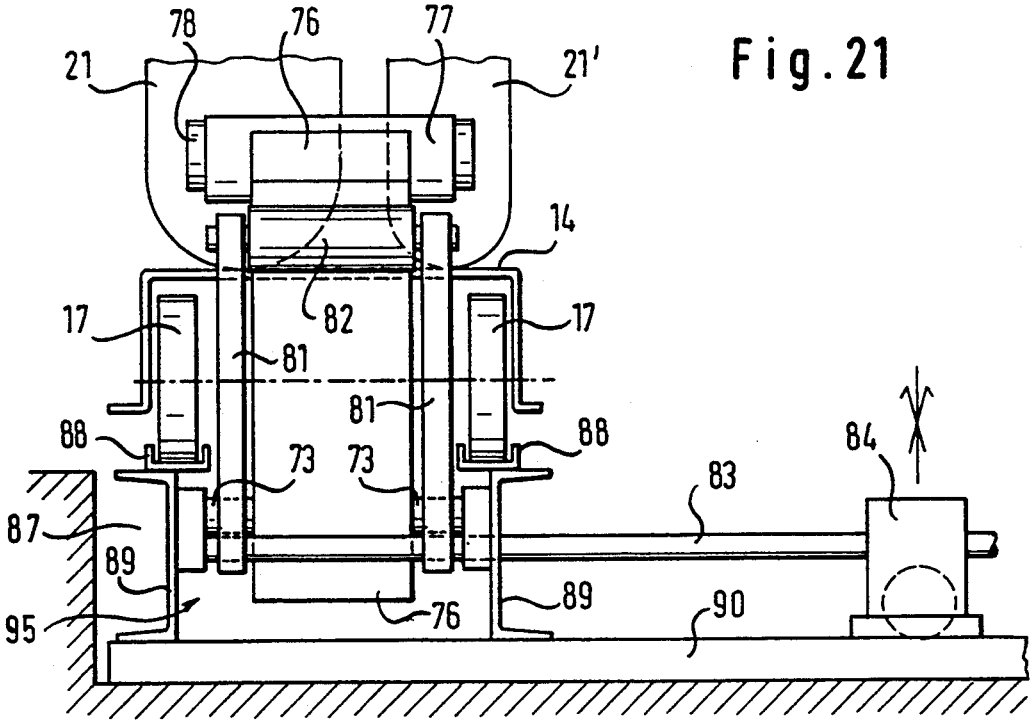
FIG. 21 is a schematic front view of FIG. 20 in the direction of the arrow XXI in FIG. 20.

FIGS. 20 and 21 show in detail the buffer apparatus 95 for the vehicle 70 and the vehicle carrying pallet 13 which is only schematically illustrated in FIG. 16 and which prevents an unintentional overtravel of the pallet during its loading. The upwardly pivotable buffer apparatus 95 is arranged so that it is of fixed location at the bottom of the loading space 66 and consists of two levers 76 which are upwardly pivotable about a bearing 73 at one end and which are aligned with the wheel supporting beams 14, with the free ends of the levers being provided with a roller 78 which is freely rotatable in a shell 77. The lever 76 can be upwardly pivoted against the direction of travel up to the level of or in direct contact with the front wheels 21, whereupon a centering angle 79 of approximately 60° to the circumference of the front wheel 21 arises which is substantially larger than the centering angle 80 between the front wheel and the front cross-beam 18 of the pallet 13.

The upward pivoting of the lever 76 is brought about by a counter pivoting lever 81 which carries a lifting roller 82 at its free end. The other ends of the levers 81 are rotationally fixedly connected to a drive shaft 83 which can be turned by a drive unit 84. During this the lifting roller 82 moves along the lower side of the lever 76 while lifting the latter up to and into the position illustrated in chain-dotted lines in FIG. 20. In this position the angle between the levers 76, 81 is approximately 90° so that the thrust forces which arise on driving of the vehicle wheel 21 up onto the roller 78 are not transferred to the drive 84 but rather only onto the shaft 83 and/or its bearing.

As a result of the free rotatability of the roller 78 in the shell no danger exists of the vehicle over-travelling the buffer apparatus 95 even when the front wheels 21 are driven because then the abutment rollers 78 can turn with them.

Towards the front the pivot angle of the lever 81 is restricted by an abutment 86 provided at the end of the lever 76 which moreover ensures the approximately 90° angle between the levers in the extended position. The pivoting back of the lever 81 out of the chain-dotted position in FIG. 20 also proceeds, having regard to the lifting roller 82 arranged at its end, with a low expenditure of force, even when in contact with a tire 21, with the likewise 90° angle between the lever 76, 81 having a positive effect in the deployed position.

An abutment 85 is also provided below the roller 78 on the abutment lever 76 which in the upwardly pivoted position illustrated in chain-dotted lines blocks the vehicle carrying pallet 13 in the loaded position against displacement forwardly through the braking reaction of the incoming vehicle.

The entire buffer apparatus 95 is accommodated in the retracted state in a recess 87 of the floor.

The recess 87 is bridged in the direction of travel of the vehicle carrying pallet 13 by rail pairs 88 at each side which have an upwardly open U-section and which accommodate and guide the wheels 17 of the vehicle carrying pallet 13. For the support of the rail pairs 88, beams 89 are laid in the recess which lie on a base plate or a plurality of base beams 90 provided at the base of the recess 87.

The buffer apparatus 95 is rigid in the extended state, i.e. is not a compressible buffer. This is also not necessary since, because of the relatively small diameter of the roll 78, the tires of the front wheels 21 yield on being driven against it and thus themselves act as a buffer. The climbing up of the front wheels which is feared in the known apparatus in similar manner with the nowadays almost universal front wheel drive and unintentional pressing of the accelerator instead of braking is avoided by the buffer apparatus 95 in that, in this case, the loose roller 78 simply turns in the shell 77 and thus prevents the lifting up of the front wheels.

The invention thus provides on the whole a vehicle parking apparatus which is suitable from every point of view for automatic control by means of computers, in particular for self-service operation by the parker and which can also be economically manufactured and used, since all individual components are matched to one another in an ideal manner.

What is claimed is:

1. Vehicle parking apparatus for use in a multi-story car park having a plurality of stories and parking boxes (11) provided in rows in said stories, the apparatus comprising at least one lift platform (12) movable between said stories, a plurality of pallets (13) each adapted to carry a vehicle to be parked, said lift platform (12) being adapted to carry at least one of said pallets, pallet drive means (32) provided on said lift platform for shifting a pallet in a direction of travel from said lift platform into a parking box and for shifting a pallet (13) in a parking box (11) in a direction opposite to said direction of travel onto said lift platform (12), each said pallet (13) comprising first and second wheel supporting beams (14) for wheels of said vehicle, each wheel supporting beam extending parallel to said direction of travel, having front and rear ends and a substantially inverted U-shape and forming a wheel carrying top surface, first and second side flanks with respective first and second lower longitudinal edges and respective outwardly directed angled flanges (15) at each of said first and second longitudinal edges, the apparatus further comprising a plurality of plates (16) connecting said first and second longitudinal edges at intervals along each wheel carrying beam and cooperating therewith to form box sections, wheel means (17) at each of said front and rear ends permitting rolling of said pallet in said direction of travel and in said direction opposite thereto, and front and rear cross-beams (18, 19) secured to said wheel carrying top surfaces of said first and second wheel supporting beams and connecting them together at a desired lateral spacing from each other, said wheel supporting beams (14) each having a length between said front and rear ends corresponding to a maximum wheel base of a vehicle to be carried, said lateral spacing corresponding to a track width of a vehicle to be carried and said front cross-beam (18) forming an abutment for front wheels of a vehicle on said pallet and said rear cross-beam (18) forming an abutment for rear wheels of a vehicle on said pallet.

2. Vehicle parking apparatus in accordance with claim 1, wherein at least said front cross-beam has an inclined surface facing an adjacent wheel of a vehicle on said pallet.

3. Vehicle parking apparatus in accordance with claim 2, wherein a third cross-beam is provided adjacent said first cross-beam and cooperates with said first cross-beam to form a wheel receiving recess at each of said wheel supporting beams to locate respective wheels of a vehicle on said pallet.

4. Vehicle parking apparatus in accordance with claim 1, wherein said front and rear cross-beams are spaced apart by a distance corresponding to a longest wheel base of a vehicle to be accommodated on said pallet.

5. Vehicle parking apparatus in accordance with claim 1, wherein said pallet drive means includes friction wheels adapted to run on the side flanks of said wheel supporting beams.

6. Vehicle parking apparatus in accordance with claim 1, wherein said wheel means at each of said front and rear ends of said wheel supporting beams comprises in each case first and second wheels and an axle extending between the side flanks of the respective wheel supporting beam (14), said first and second wheels each being arranged close to the respectively adjacent side flank of the associated wheel supporting beam.

7. Apparatus in accordance with claim 1 for use in a multi-story car park having a pallet loading space, the apparatus further comprising support means in said pallet loading space and disposed beneath said wheel supporting beams beneath said flanges thereof and between said front and rear ends thereof to support said wheel supporting beams during loading of a vehicle onto a pallet in said loading space.

8. Apparatus in accordance with claim 7, wherein said support means comprises at least two support rolls arranged alongside one another in a fixed arrangement.

9. Apparatus in accordance with claim 8, wherein a plurality of support rolls are arranged behind one another beneath each said wheel supporting beam.

10. Apparatus in accordance with claim 7, wherein said support means permanently engage with said flanges of said wheel supporting beams when a pallet is present in said loading space.

11. Apparatus in accordance with claim 7, including first and second wheel guiding beams in said loading space outside of said first and second wheel supporting beams.

12. Apparatus in accordance with claim 11, including mounting means permitting restricted outward movement of said guide beams away from an initial position thereof, and resilient resetting means for returning said guide beams to said initial position.

13. Apparatus in accordance with claim 12, wherein said mounting means comprise first and second outriggers for each guide beam, said outriggers being spaced apart along the respectively adjacent wheel supporting beam, vertical pivot means for connecting said first and second outriggers to said loading space, and hinge means connecting each said guide beam to each of said outriggers, said outriggers being obliquely inclined to said wheel supporting beams.

14. Apparatus in accordance with claim 13, wherein said resilient resetting means act on at least one outrigger of each guide beam.

15. Apparatus in accordance with claim 13 for use in a multi-story car park having a door providing access from said loading space to said lift platform, the apparatus further comprising latch devices which cooperate with said door to block said guide beams in said initial position when said door is closed and which permit outward displacement of said guide beams through pivoting of said outriggers when said door is open.

16. Apparatus in accordance with claim 7 including further guide beams in said loading space between said wheel supporting beams and said cross-beams of a pallet present in said loading space, each said further guide beam being disposed adjacent to an inner side flank of a respective one of said wheel supporting beams, and raising and lowering means for raising said further guide beams from a lowered position in which they do not hinder displacement of a said pallet into said loading space and a raised position above said top surfaces of said wheel supporting beams in which they form inner guide surfaces for wheels of vehicles being positioned on the said pallet.

17. Apparatus in accordance with claim 16 and further comprising floor plates on which said further guide beams are arranged, and hinge means for said floor plates, wherein said raising and lowering means comprises means for pivoting said floor plates about said hinge means.

18. Apparatus in accordance with claim 17, wherein said raising and lowering means comprises an eccentric device and a hinged linkage having an upper dead point portion when said further guide beams are in said raised position.

19. Apparatus in accordance with claim 16 for use in a multi-story car park having a door providing access from said loading space to said lift platform, the apparatus further comprising means for synchronizing operation of said raising and lowering means with opening and closing of said door.

20. Apparatus in accordance with claim 7, including in-feed rollers disposed in said loading space in front of a pallet disposed therein.

21. Apparatus in accordance with claim 20, wherein said in-feed rollers are elongate rollers located inwardly of said wheel supporting beams at an angle to each other for guiding front wheels of a vehicle moving onto said pallet so that they are aligned with said wheel supporting beams.

22. Apparatus in accordance with claim 7 and further comprising a pivotable beam associated with each wheel carrying beam, each said pivotable beam being arranged in said loading space in the direction of travel in front of a vehicle carrying pallet located there, being connected at one end to an axle arranged beneath said wheel means at said front end of said pallet, and carrying a freely rotatable roller arranged at its other end as a first abutment for the stopping of the front wheels of incoming vehicles, and wherein each said pivotable beam is provided with a second abutment for the vehicle carrying pallet (13).

23. Apparatus in accordance with claim 22 and further comprising a door between said loading space and said lift platform, wherein a lever on a motor driven shaft is provided for lifting each pivotable beam when said door is closed from a rest position beneath the vehicle carrying pallet up to an upper dead point, whereby movements of a vehicle on a pallet and of the pallet are stabilized by said first and second abutments.

24. Apparatus in accordance with claim 1 for use in a multi-story car park having a pallet unloading space, the apparatus further comprising support means in the pallet unloading space and disposed beneath said wheel supporting beams beneath said flanges thereof and between said front and rear ends thereof to support said wheel supporting beams during unloading of a vehicle onto a pallet in said unloading space.

25. Apparatus in accordance with claim 24, wherein said support means comprises at least two support rolls arranged alongside one another in a fixed arrangement.

26. Apparatus in accordance with claim 25, wherein a plurality of support rolls are arranged behind one another beneath each said wheel supporting beam.

27. Apparatus in accordance with claim 24, wherein said support means permanently engage with said flanges of said wheel supporting beams when a pallet is present in said unloading space.

28. Apparatus in accordance with claim 1, wherein said pallet drive means comprises a shifting beam mounted on said lift platform and guided for movement in said direction of travel and in said direction opposite thereto, means for moving said shifting beam in said direction of travel and in said opposite direction, friction rollers supported by said shifting beam and engageable with said pallets and driving means on said shifting beam for rotating said friction rollers and thereby displacing said pallet from said lift platform into a parking box and vice versa.

29. Apparatus in accordance with claim 28, wherein, with a pallet on said lift platform, said shifting beam is located between said wheel supporting beams and beneath said cross-beams, and wherein said friction rollers engage said side flanks of said wheel supporting beams.

30. Apparatus in accordance with claim 29, wherein said shifting beam has first and second ends and said friction rollers comprise at least first and second friction rollers arranged at one end of said shifting beam.

31. Apparatus in accordance with claim 30, wherein said friction rollers also comprise third and fourth friction rollers arranged at another said end of said shifting beam.

32. Apparatus in accordance with claim 30, wherein said driving means for said friction rollers comprise a transmission drive group, the apparatus further comprising hinge means for pivotally mounting said transmission drive group on said shifting beam and resilient means for resiliently pressing said friction rollers against said side flanks of said pallet, thus generating points of contact between said friction rollers and said side flanks, and wherein a straight line drawn between each said point of contact and the hinge means of the transmission drive group defines an acute angle ($\alpha$) with said direction of travel when moving away from said lift platform.

33. Apparatus in accordance with claim 32, wherein said acute angle ($\alpha$) lies in the range from 15° to 45°.

34. Apparatus in accordance with claim 33, wherein said acute angle ($\alpha$) lies in the range from 20° to 40°.

35. Apparatus in accordance with claim 34, wherein said acute angle ($\alpha$) amounts to substantially 30°.

36. Apparatus in accordance with claim 28 and further comprising a central auxiliary rail having side flanks mounted on said cross-beams between said wheel supporting beams and extending parallel thereto, wherein, with a pallet on said lift platform, said shifting beam is located between said wheel supporting beams and beneath said cross-beams, and wherein said friction rollers engage with side flanks of said central auxiliary rail.

37. Apparatus in accordance with claim 36, wherein said shifting beam has first and second ends and said friction rollers comprise at least first and second friction rollers arranged at one end of said shifting beam.

38. Apparatus in accordance with claim 37, wherein said friction rollers also comprise third and fourth friction rollers arranged at the other said end of said shifting beam.

39. Apparatus in accordance with claim 37, wherein said driving means for said friction rollers comprise a transmission drive group, the apparatus further comprising hinge means for pivotally mounting said transmission drive group on said shifting beam and resilient means for resiliently pressing aid friction rollers against said side flanks of said central auxiliary rail, thus generating points of contact between said friction rollers and said side flanks and wherein a straight line drawn between each said point of contact and the hinge means of the transmission drive group defines an acute angle ($\alpha$) with said direction of travel when moving away from said lift platform.

40. Apparatus in accordance with claim 39, wherein said acute angle ($\alpha$) lies in the range from 15° to 45°.

41. Apparatus in accordance with claim 39, wherein said acute angle ($\alpha$) lies in the range from 20° to 40°.

42. Apparatus in accordance with claim 39, wherein said acute angle ($\alpha$) amounts to substantially 30°.

43. Apparatus in accordance with claim 28, wherein said shifting beam comprises an elongate beam with a substantially C-shaped cross-section having profiled side flanks, wherein guide wheels for said shifting beam are pivotally mounted on said lifting platform, are rotatable about substantially vertical axes and have peripheral portions of a shape complementary to said profiled side flanks and cooperate with said profiled side flanks to support said beam in a horizontal plane while permitting displacement thereof in said direction of travel and in a direction opposite thereto.

44. Apparatus in accordance with claim 43, wherein said C-shaped cross-section is open upwardly and said guide wheels are disposed outside of said shifting beam.

45. Apparatus in accordance with claim 43, wherein said C-section is open downwardly and said guide wheels are disposed within said shifting beam.

46. Apparatus in accordance with claim 43, wherein said side flanks have a sigma shape in cross-section.

47. Apparatus in accordance with claim 28, wherein said means for moving said shifting beam comprises a flexible draw member.

48. Apparatus in accordance with claim 47, wherein said flexible draw member comprises a toothed belt.

49. Apparatus in accordance with claim 47 and further comprising means for securing said flexible draw member to said shifting beam and deflection rollers disposed at opposite sides of said lift platform around which said flexible draw member extends and means for driving one of said deflection rollers to drive said flexible draw member and thus said shifting beam.

50. Apparatus in accordance with claim 28, including first and second support rollers having horizontal axes of rotation disposed transverse to said direction of travel and provided at respective ends of said driving beam.

* * * * *